United States Patent [19]

Stambolov et al.

[11] Patent Number: 4,678,615

[45] Date of Patent: Jul. 7, 1987

[54] COOLING STACK FOR COOLING TOWERS

[75] Inventors: Lyuben K. Stambolov, Sofia; Sotir Y. Chaushev; Dilyan L. Simitchiev, both of Burgas, all of Bulgaria

[73] Assignee: DSPIE "D. Blagoev", Kardjali, Bulgaria

[21] Appl. No.: 888,860

[22] Filed: Jul. 23, 1986

[51] Int. Cl.[4] ..... B01F 3/04

[52] U.S. Cl. ..... 261/111; 261/112; 261/DIG. 11

[58] Field of Search ..... 261/111, 112, DIG. 11

[56] References Cited

U.S. PATENT DOCUMENTS

| | | | |
|---|---|---|---|
| 3,402,105 | 9/1968 | Sze | 261/112 |
| 3,450,393 | 6/1969 | Munters | 261/112 |
| 3,540,855 | 11/1970 | Moure et al. | 261/112 |
| 3,749,381 | 7/1973 | Furlong et al. | 261/111 |
| 3,969,447 | 7/1976 | Glitsch et al. | 261/112 |
| 4,052,491 | 10/1977 | Lefevre | 261/DIG. 11 |
| 4,512,937 | 4/1985 | Hoffmann | 261/111 |

FOREIGN PATENT DOCUMENTS

| | | | |
|---|---|---|---|
| 1542197 | 6/1970 | Fed. Rep. of Germany | 261/111 |
| 1809605 | 6/1970 | Fed. Rep. of Germany | 261/111 |
| 2801500 | 7/1978 | Fed. Rep. of Germany | 261/112 |

*Primary Examiner*—Tim Miles

[57] ABSTRACT

A cooling stack for a cooling tower comprises at least one volumetric polymer block of a flow-around type. Each block is built up of polyhedron shaped cells. The blocks are mounted in the cooling tower by means of connecting strips strung up on suspension devices suspended to a carrying construction disposed inside the cooling tower. Each block comprises at least two flow-around type layers. The layers are arranged in the block vertically at a distance one above the other. Each layer is made up of rows of cellular components, mounted detachably by means of connecting teeth to connecting seats in small carrying bars. The small carrying bars are mounted to the connecting strips strung up on the suspension devices which are divided by spacing sleeves.

4 Claims, 4 Drawing Figures

COOLING STACK FOR COOLING TOWERS

This invention relates to a cooling stack for cooling towers which can be applied in power, chemical, metallurgical, and food engineering.

BACKGROUND OF THE INVENTION

A known cooling stack for cooling towers comprises a plurality of vertically arranged layers of cellular bricks, disposed vertically at a distance one form another. The cells of the bricks of each layer are offset with respect to the cells of adjacent layers. Spacers are provided, disposed between every two adjacent layers, to ensure the vertical distance between the layers. The height of each layer is within the range of from 127 to 203 mm, while the height of the spacers and, respectively, the distance between the adjacent layers is from 25 to 102 mm. The layers are arranged one above the other, and the bricks of each layer are balanced by the bricks of the adjacent layers. See, for example, U.K. Patent Specification No. 2106662217, Int'l. Class F28F 25/00.

A basic drawback of the known cooling stack for cooling towers described above is the multitude of components, bricks and spacers, which results in difficulties in assembly and disassembly of the cooling stack in the cooling tower.

Another known cooling stack for cooling towers comprises a plurality of volumetric polymer blocks of the flow-around type. Each block is built-up of honeycomb-shaped cells. The blocks are mounted detachably in cassettes which have connecting strips, vertically strung up on suspension devices, suspended to a carrying construction disposed inside the cooling tower.

A drawback of this cooling stack lies in the comparatively great height of the polymer blocks of the flow-around type, which height impairs the heat and mass exchange between the cooled liquid and the air and results in a reduction of the capacity of the cooling tower.

It is therefore a general object of this invention to provide a cooling stack for cooling towers in which the process of heat and mass exchange between the liquid and the air is intensified, resulting in an increase of the degree of cooling and an increase in the productivity of the cooling tower.

SUMMARY OF THE INVENTION

This object is achieved by a cooling stack for cooling towers which comprises at least one volumetric polymer block of a flow-around type, each block being built-up of honeycomb shaped cells. The blocks are mounted in the cooling tower by means of a plurality of connecting strips, vertically strung up on suspension devices, suspended to a carrying construction disposed inside the cooling tower. According to the invention, each block comprises at least two flow-around type layers. The layers are arranged in the block vertically at a distance one above the other. Each layer is made up of rows of cellular components, mounted detachably by means of connecting teeth to connecting seats of small carrying bars. The small carrying bars are mounted to the connecting strips, strung up on the suspension devices, which are limited by spacing sleeves.

According to one preferred embodiment of the flow-around layers, depending on the load, the cells of each layer on the block are offset with respect to the cells of adjacent layers. According to another embodiment, the layers mounted in the block are inclined with respect to the horizontal plane.

In yet another embodiment of the invention, a drip irrigator comprising joint polymer grids is mounted above the flow-around layers of the polymer blocks.

The advantages of the cooling stack for cooling towers according to the invention are:

by shaping layers in the polymer block of flow-around type there are provided conditions for intensification of the heat and mass exchange between the cooled liquid and the air and this results in an increase in the capacity of the cooling tower;

by providing detachably suspended rows and layers and by the reduction of the number of components in each layer, the time for assembly and disassembly of the cooling stack in the cooling tower is reduced.

BRIEF DESCRIPTION OF THE DRAWINGS

With these and other objects in view, which will become apparent in the following detailed description, the present invention, which is shown by example only, will be clearly understood in connection with the accompanying drawing, in which.

DETAILED DESCRIPTION OF THE DRAWINGS

Figure 1:
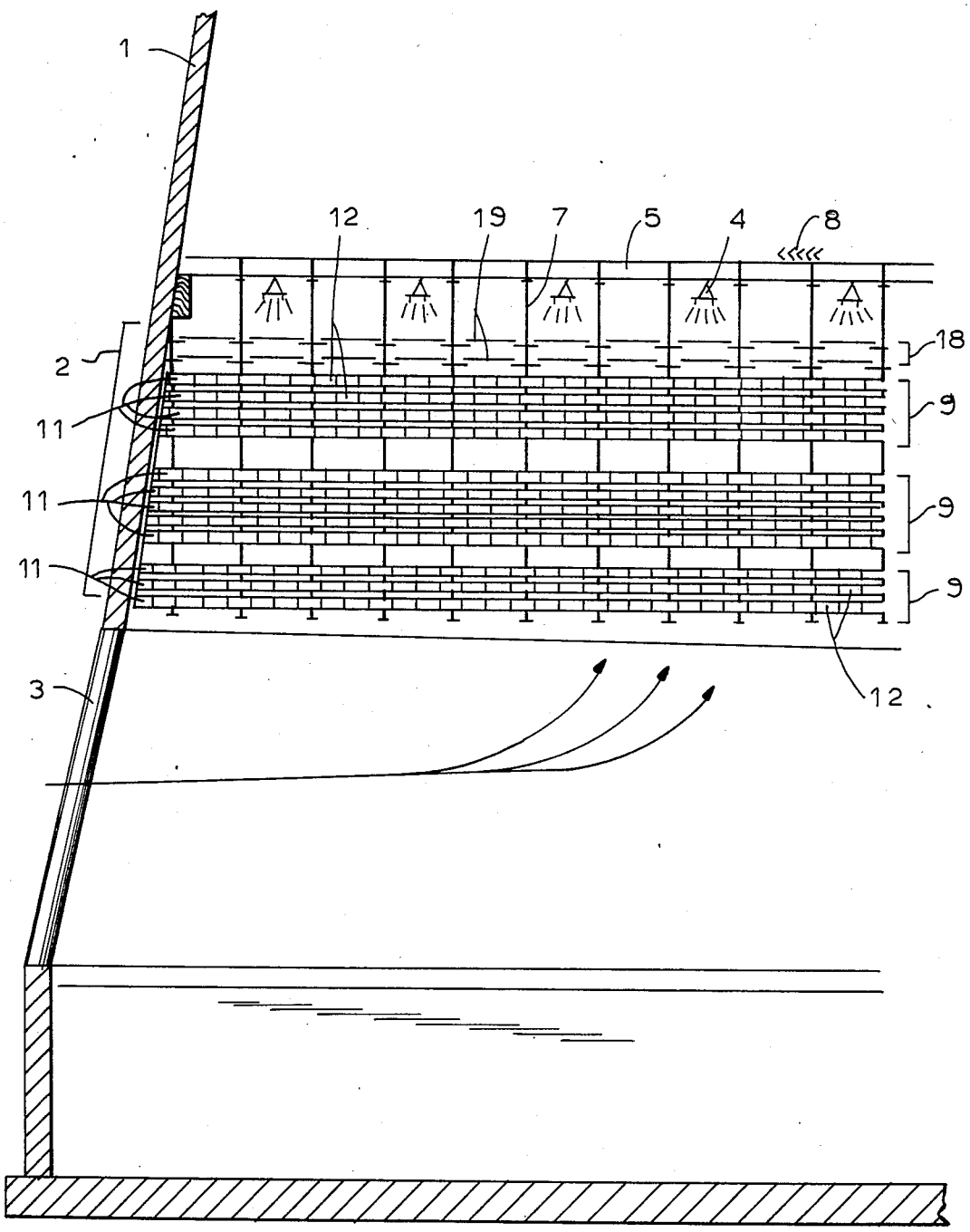
FIG. 1 is a partial vertical cross-sectional view of the cooling tower with a mounted cooling stack.

In the cooling tower 1 there is mounted a cooling stack 2 disposed above holes 3 for the entry of cooling air and underneath nozzles 4 of the liquid distributing device 5. The cooling stack 2 is suspended on connecting strips 6 strung up vertically on suspension device 7, connected to the pipes of the distributing device 5. Above the liquid distributing device 5, there is provided a drip separator 8.

Figure 2:
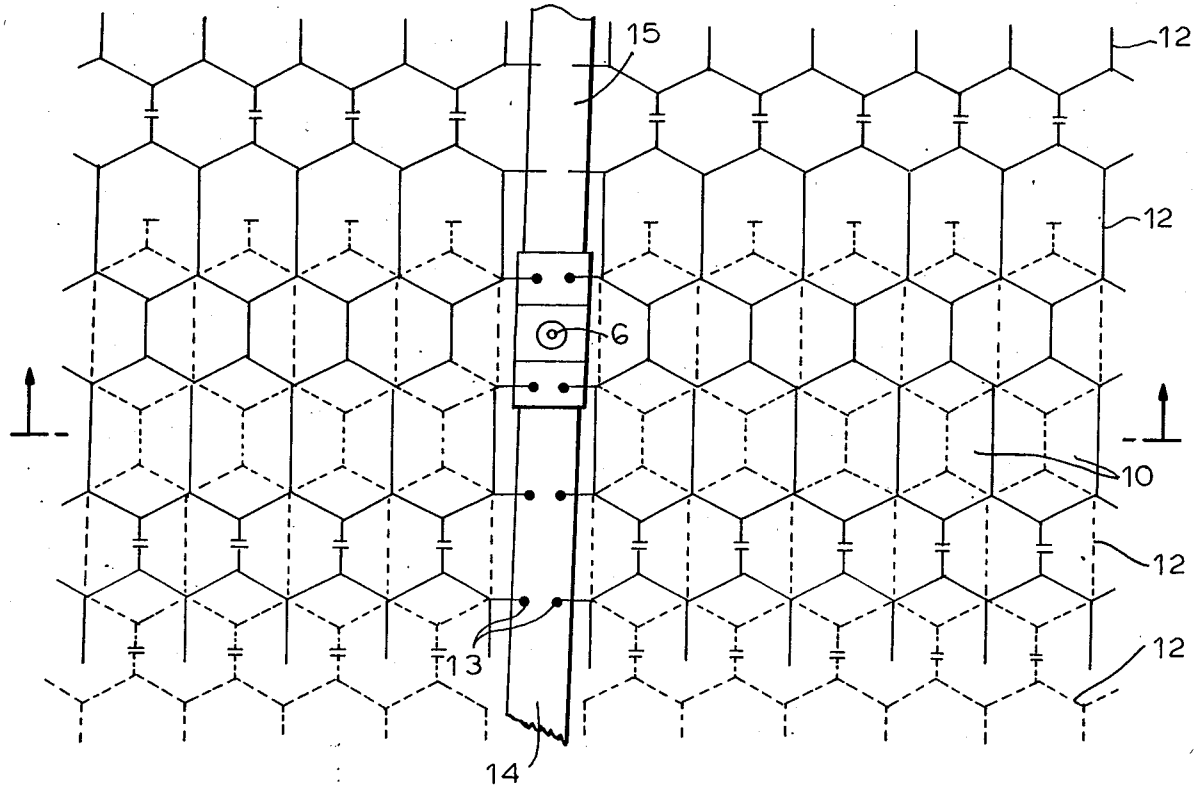
FIG. 2 is a top view of the cells showing their offset in adjacent layers of one block of the cooling stack.
Figure 3:
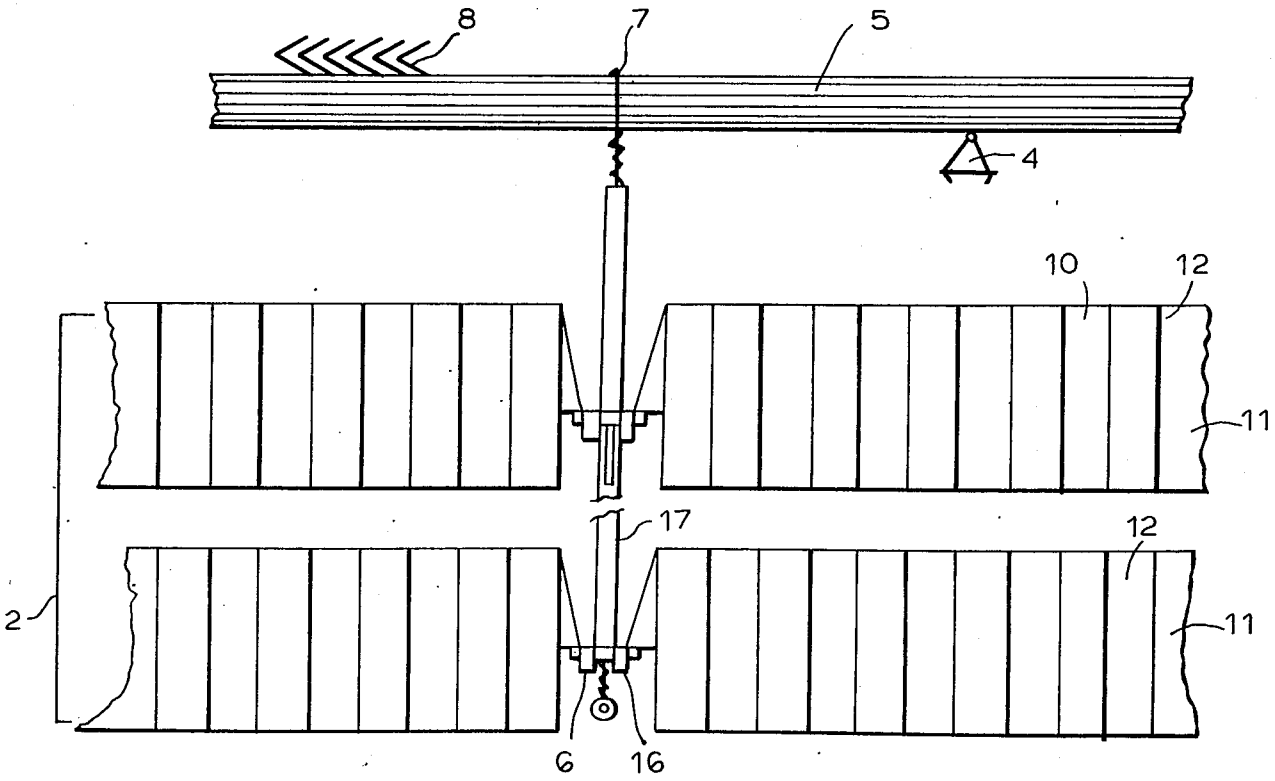
FIG. 3 is a partial vertical cross-sectional view of two layers of flow-around type, mounted to the suspension device, connected to water distributing pipes.
Figure 4:
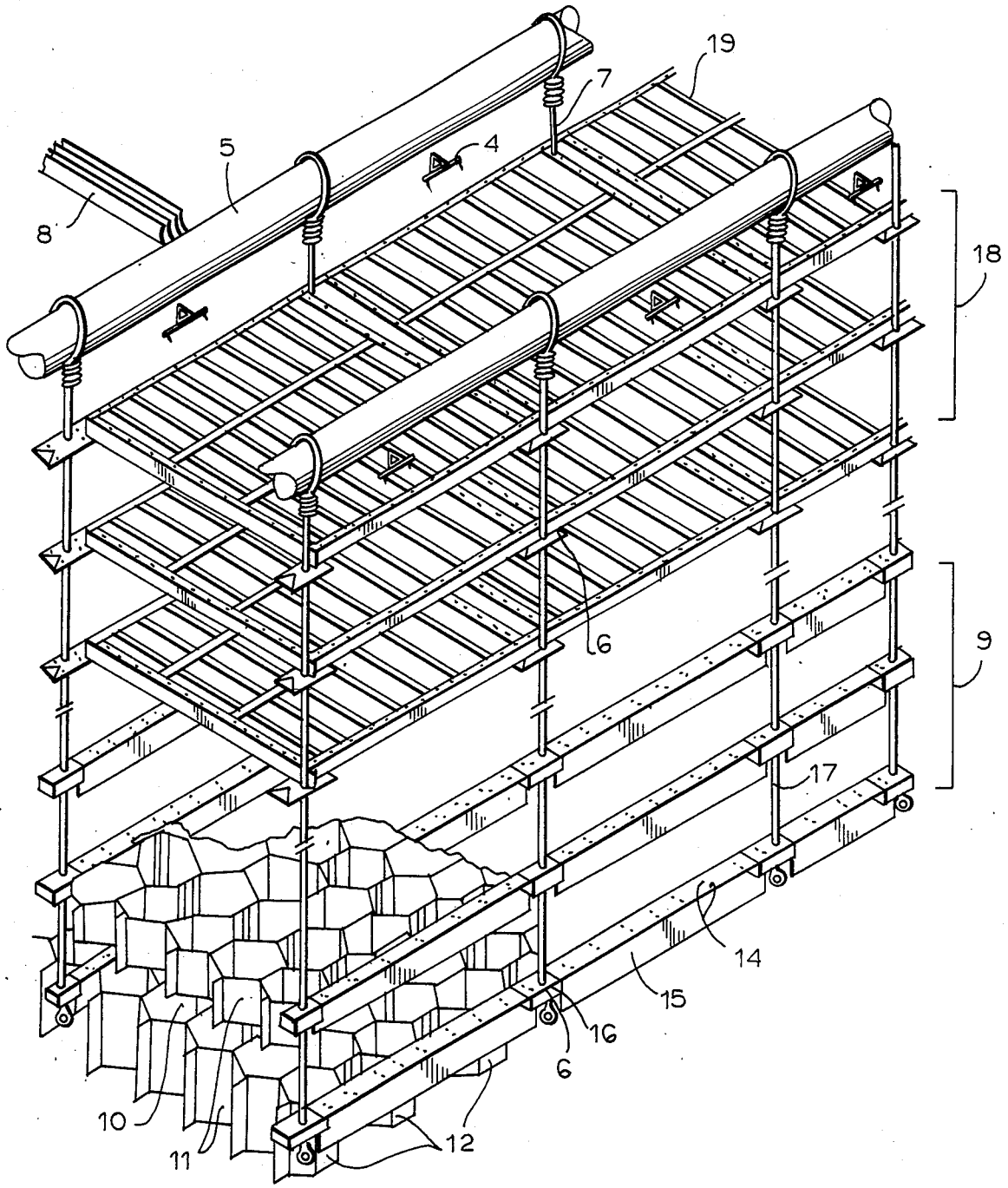
FIG. 4 is an axonometric view of the cooling stack with two layers of flow-around type showing the drip irrigator mounted above them.

The cooling stack 2 is built up of three volumetric polymer blocks 9 of flow-around type with polyhedron shaped cells 10 (See FIGS. 2 and 4). Each block 9 comprises flow-around layers 11 arranged in the given block 9 vertically at a distance from each other. Each flow-around layer 11 is made up of rows of cellular components 12 which are provided with connecting teeth 13. By means of the connecting teeth 13, the rows of cellular components 12 of a given flow-around layer 11 are mounted detachably to the connecting seats 14 of small carrying bars 15. The small carrying bars 15 are mounted by the cylindrical walls 16 of the seats 14 to the connecting strips 6, which are strung up on the suspension devices 7. The vertical distance between the flow around layers 11 in a given block 9 and between the blocks 9 is achieved by means of spacing sleeves 17 mounted between the connecting strips 6.

The flow-around layers 11 in one polymer block 9 are arranged so that the cells 10 of the cellular components 12 of each layer 11 are offset in staggered rows with respect to the cells 10 of its adjacent layers 11 (See FIGS. 2 and 4).

Above the flow-around layers 11 of the polymer blocks 9, there is mounted on the suspension device 7 a drip irrigator 18 built up of joined polymer grids 19 (See FIGS. 1 and 4).

The operation of the cooling stack for cooling towers, according to the invention, is as follows:

Via the liquid distributing device 5 and the nozzles 4, the liquid is delivered in the cooling tower 1 and is distributed on the drip irrigator 18. Onto the grids 19 of the drip irrigator 18 the liquid is dispersed and reaches the layers 11 of the blocks 9 of the cooling stack 2 of flow-around type. Because of the comparatively small height of the layers 11 and their vertical arrangement at a distance from each other in block 9, on the walls of the cells 10 there is formed a uniform layer of entering finely dispersed liquid. This intensifies the heat and mass exchange between the liquid and the entering cooling air in counter-current via the holes 3 of the cooling tower 1, thus increasing its capacity.

At high hydraulic loads, the flow-around layers 11 in block 9 are arranged so that the cells 10 of the cellular components 12 of each layer 11 are offset with respect to the cells 10 of its adjacent layers 11 in block 9. This offset makes it possible to increase the total cooling surface and provides a protection of the formed liquid curtain from a deflection by the air swirls of the air flowing in counter-current. After leaving the first layer 11 in the respective block 9 of the flow-around cooling stack 2, part of the liquid falls onto the edges of the cells 10 of the underneath layer 11 and is again dispersed, and this again intensifies the heat and mass exchange between the liquid and the air and makes it possible to increase the capacity of the cooling tower 1.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A cooling stack for a cooling tower comprising a volumetric polymer block of flow-around type having polyhedron shaped cells, said block comprising two flow-around layers, each layer comprising a plurality of rows of cellular components, said components being mounted detachably by means of connecting teeth to connecting seats of carrying bars, said bars being fastened to connecting strips, said strips being hung on vertical suspension devices attached to a carrying construction, said layers being disposed at a distance from one another vertically by spacing sleeves on said suspension devices.

2. A cooling stack for a cooling tower according to claim 1 wherein each layer in the block is arranged so that its cells are offset with respect to the cells of its adjacent layer.

3. A cooling stack for a cooling tower according to claim 1 wherein above the flow-around layers of the blocks there is mounted a drip irrigator comprising joined polymer grids.

4. A cooling stack for a cooling tower according to claim 1 wherein the layers are mounted inclined with respect to a horizontal plane.

* * * * *